US007112106B1

(12) United States Patent
Su

(10) Patent No.: US 7,112,106 B1
(45) Date of Patent: Sep. 26, 2006

(54) QUICK CONNECTING DEVICE FOR ELECTRIC CORDS

(76) Inventor: Hsin-Cheng Su, 466, Chung Shang Rd., Shi Kang Hsiang, Tainan Shien (TW)

( * ) Notice: Subject to any disclaimer, the term of this patent is extended or adjusted under 35 U.S.C. 154(b) by 0 days.

(21) Appl. No.: 11/333,645

(22) Filed: Jan. 17, 2006

(51) Int. Cl.
*H01R 4/50* (2006.01)

(52) U.S. Cl. ..... 439/805; 439/784

(58) Field of Classification Search ..... 439/805, 439/784, 727, 428, 937
See application file for complete search history.

(56) References Cited

U.S. PATENT DOCUMENTS 1,190,524 A * 7/1916 Douglas ..... 439/738
2,463,144 A * 3/1949 Buchanan ..... 439/805
2,466,997 A * 4/1949 Morris ..... 439/732
3,010,747 A * 11/1961 Bondon ..... 403/281
4,204,739 A * 5/1980 Shoenleben ..... 439/263
5,695,369 A * 12/1997 Swenson, Sr. ..... 439/784
6,488,548 B1 * 12/2002 Tomasino ..... 439/784
6,796,853 B1 * 9/2004 Tomasino ..... 439/784

* cited by examiner

*Primary Examiner*—Hien Vu
(74) *Attorney, Agent, or Firm*—Alan D. Kamrath; Nikolai & Mersereau, P.A.

(57) ABSTRACT

A quick connecting device includes a first connector, a metallic mounting ring, a first electric cord, a second connector, a second electric cord, a metallic conductive plug, and an elastic member. Thus, the second exposed electric wires of the second electric cord is clamped by the conductive plug, and the first exposed electric wires of the first electric cord is clamped between the conductive plug and the mounting ring, so that the second electric cord is connected to the first electric cord exactly.

19 Claims, 4 Drawing Sheets

QUICK CONNECTING DEVICE FOR ELECTRIC CORDS

BACKGROUND OF THE INVENTION

1. Field of the Invention

The present invention relates to a quick connecting device and, more particularly, to a quick connecting device for electric cords.

2. Description of the Related Art

A conventional quick connecting device in accordance with the prior art shown in FIGS. 8 and 9 comprises a first connector 5' having a first end formed with a first receiving chamber 51' and a second end formed with a second receiving chamber 52', a first electric cord 61' having a distal end extended through the second receiving chamber 52' of the first connector 5' and provided with first exposed electric wires 612' extended into the first receiving chamber 51' of the first connector 5', a second connector 1' having a first end formed with a mounting chamber 11' mounted on the first connector 5' and a second end formed with a through hole 12', and a second electric cord 62' having a distal end extended through the through hole 12' of the second connector 1' into the mounting chamber 11' and provided with a metallic contact 3' inserted into the first receiving chamber 51' of the first connector 5' to contact the first exposed electric wires 612' of the first electric cord 61' so as to connect the second electric cord 62' to the first electric cord 61'. The first connector 5' has a mediate portion formed with a reduced neck portion 53' located between and connected to the first receiving chamber 51' and the second receiving chamber 52'. The first end of the first connector 5' has an outer wall formed with an outer thread 511'. The first electric cord 61' has an insulating outer cover 611' stopped by the neck portion 53' of the first connector 5'. The first end of the second connector 1' has an inner wall formed with an inner thread 111' screwed onto the outer thread 511' of the first connector 5'. The first exposed electric wires 612' of the first electric cord 61' is clamped between the metallic contact 3' of the second electric cord 62' and the first receiving chamber 5' of the first connector 5'.

However, the first connector 5' and the second connector 1' are made of plastic material, so that when the quick connecting device is immersed into an oily liquid (such as hot oil contained in the gearbox of a car) at a high temperature, the first connector 5' is easily deformed due to the high heat to loosen the first exposed electric wires 612' of the first electric cord 61' from the clamping state between the metallic contact 3' and the first connector 5', thereby decreasing the electrical connection between the first electric cord 61' and the second electric cord 62'. In addition, the first connector 5' and the second connector 1' are easily deformed due to the high heat so that the first connector 5' is easily loosened from the second connector 1' to fail operation of the first electric cord 61' and the second electric cord 62'. Further, the metallic contact 3' is hidden in the mounting chamber 11' of the second connector 1' so that the metallic contact 3' is not aligned with the first receiving chamber 51' of the first connector 5' easily, and the second connector 1' is not connected with the first connector 5' easily.

SUMMARY OF THE INVENTION

In accordance with the present invention, there is provided a quick connecting device, comprising a first connector having a first end formed with a first receiving chamber and a second end formed with a second receiving chamber, a metallic mounting ring mounted in the first receiving chamber of the first connector and having a first end formed with a receiving space and a second end formed with a passage, a first electric cord having a distal end extended through the second receiving chamber of the first connector and provided with first exposed electric wires extended into the receiving space of the mounting ring, a second connector having a first end formed with a mounting chamber mounted on the first connector and a second end formed with a through hole, a second electric cord having a distal end extended through the through hole of the second connector into the mounting chamber and provided with second exposed electric wires, a metallic conductive plug secured on the second exposed electric wires of the second electric cord and inserted into the receiving space of the mounting ring to contact the first exposed electric wires of the first electric cord so as to connect the second electric cord to the first electric cord, and an elastic member biased between the second connector and the conductive plug.

The primary objective of the present invention is to provide a quick connecting device having an excellent contact conductive effect.

Another objective of the present invention is to provide a quick connecting device, wherein the second exposed electric wires of the second electric cord is clamped by the conductive plug, and the first exposed electric wires of the first electric cord is clamped between the conductive plug and the mounting ring, so that the second electric cord is connected to the first electric cord exactly.

A further objective of the present invention is to provide a quick connecting device, wherein each of the conductive plug and the mounting ring is formed with an electrically plated layer so that the second electric cord is connected to the first electric cord smoothly by the conductive plug and the mounting ring.

A further objective of the present invention is to provide a quick connecting device, wherein the second electric cord and the first electric cord are clamped and electrically conducted by the conductive plug and the mounting ring, so that the second electric cord is connected to the first electric cord constantly by the conductive plug and the mounting ring even when the quick connecting device is immersed into an oily liquid at a high temperature.

A further objective of the present invention is to provide a quick connecting device, wherein the conic portion of the conductive plug protrudes outward from the mounting chamber of the second connector by the elastic force of the elastic member so that the conductive plug is aligned with and inserted into the receiving space of the mounting ring easily and rapidly, thereby facilitating a user connecting the second connector to the first connector.

A further objective of the present invention is to provide a quick connecting device, wherein the inner thread of the second connector is fitted on the outer thread of the first connector closely by the elastic force of the elastic member so that the second connector is combined with the first connector closely to prevent the second connector from detaching from the first connector during a long-term utilization.

A further objective of the present invention is to provide a quick connecting device, wherein the first connector has a holding portion, and the second connector has a holding portion to facilitate the user holding and rotating the first connector.

Further benefits and advantages of the present invention will become apparent after a careful reading of the detailed description with appropriate reference to the accompanying drawings.

BRIEF DESCRIPTION OF TILE DRAWINGS

DETAILED DESCRIPTION OF THE INVENTION

Figure 1:
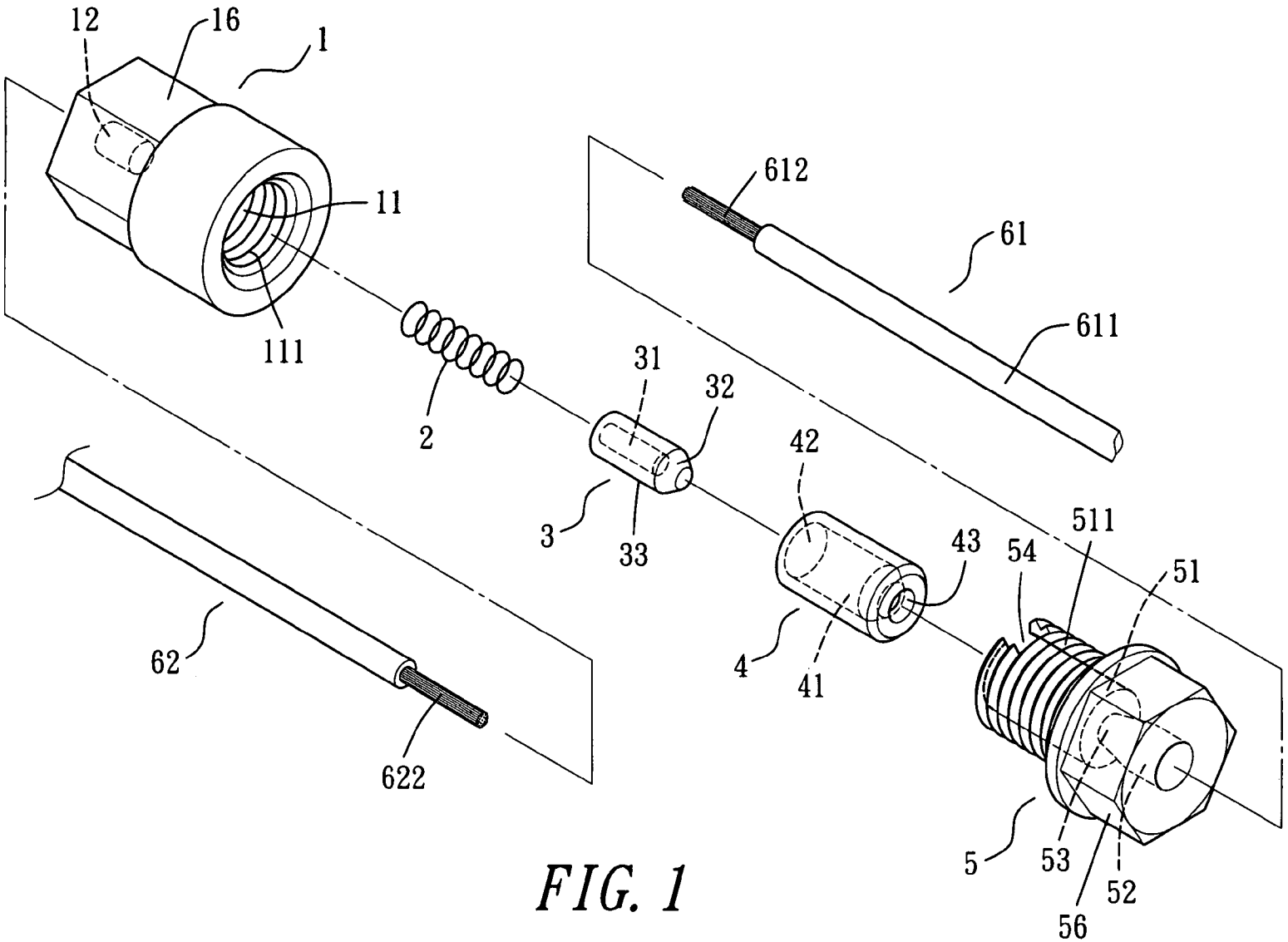
FIG. 1 is an exploded perspective view of a quick connecting device in accordance with the preferred embodiment of the present invention.
Figure 2:
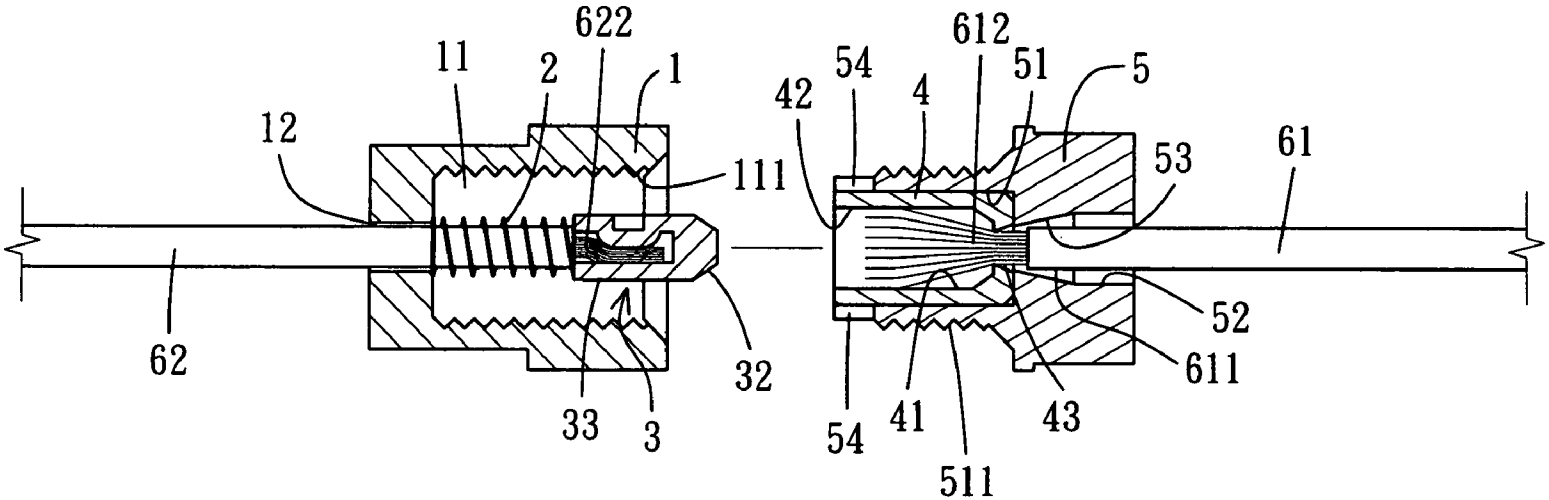
FIG. 2 is a plan exploded cross-sectional view of the quick connecting device as shown in FIG. 1.
Figure 3:
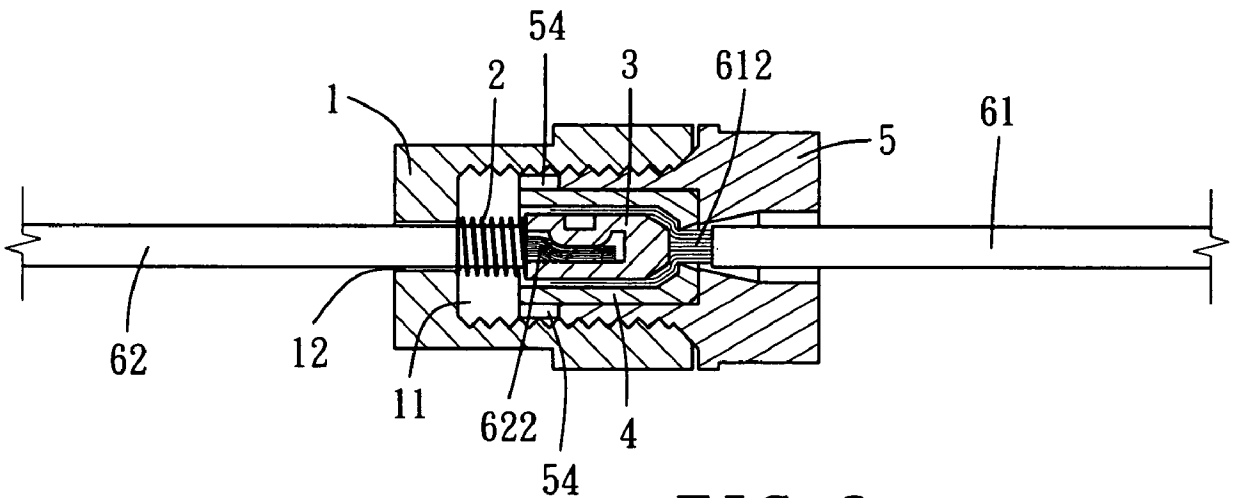
FIG. 3 is a plan cross-sectional assembly view of the quick connecting device as shown in FIG. 2.
Figures 4, 5, 6, 7:
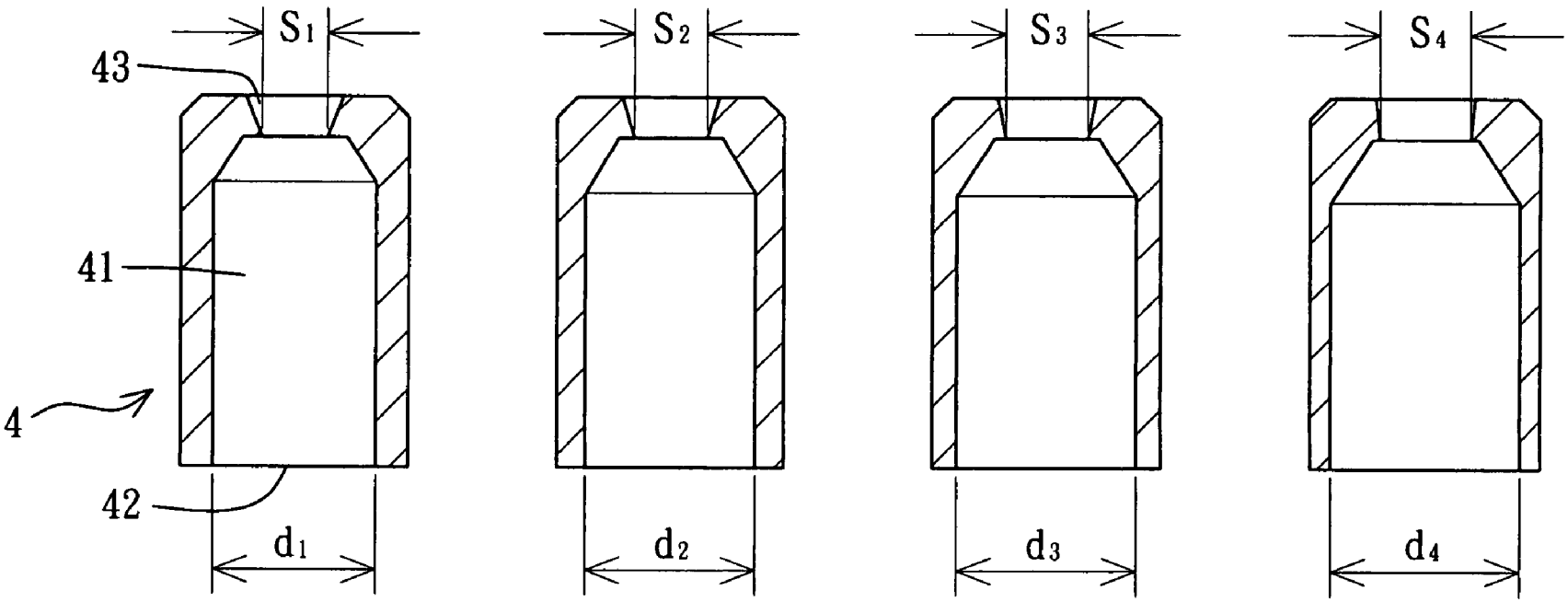
FIGS. 4–7 are plan cross-sectional views each showing a metallic mounting ring of the quick connecting device as shown in FIG. 1.
Figure 8:
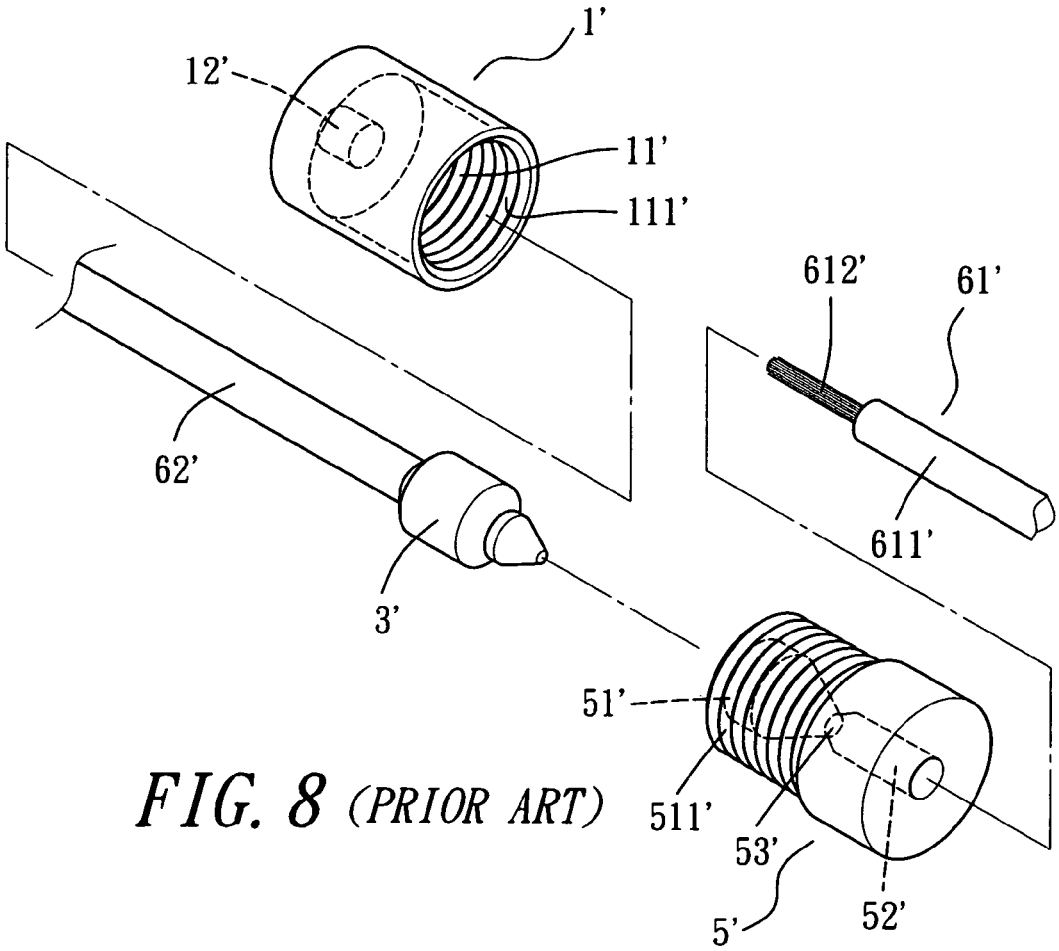
FIG. 8 (PRIOR ART)
FIG. 8 is an exploded perspective view of a conventional quick connecting device in accordance with the prior art.
Figure 9:
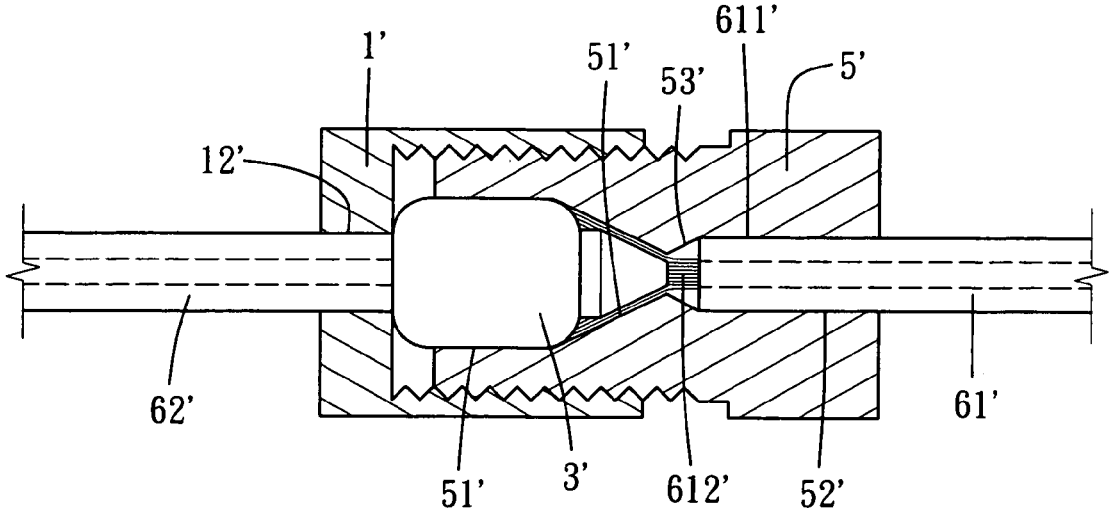
FIG. 9 (PRIOR ART)
FIG. 9 is a plan cross-sectional assembly view of the conventional quick connecting device as shown in FIG. 8.

Referring to the drawings and initially to FIGS. 1–3, a quick connecting device in accordance with the preferred embodiment of the present invention comprises a first connector 5 having a first end formed with a first receiving chamber 51 and a second end formed with a second receiving chamber 52, a metallic mounting ring 4 mounted in the first receiving chamber 51 of the first connector 5 and having a first end formed with a receiving space 41 and a second end formed with a passage 43, a first electric cord 61 having a distal end extended through the second receiving chamber 52 of the first connector 5 and provided with first exposed electric wires 612 extended into the receiving space 41 of the mounting ring 4, a second connector 1 having a first end formed with a mounting chamber 11 mounted on the first connector 5 and a second end formed with a through hole 12, a second electric cord 62 having a distal end extended through the through hole 12 of the second connector 1 into the mounting chamber 11 and provided with second exposed electric wires 622, a metallic conductive plug 3 secured on the second exposed electric wires 622 of the second electric cord 62 and inserted into the receiving space 41 of the mounting ring 4 to contact the first exposed electric wires 612 of the first electric cord 61 so as to connect the second electric cord 62 to the first electric cord 61, and an elastic member 2 biased between the second connector 1 and the conductive plug 3.

The first connector 5 has a mediate portion formed with a reduced neck portion 53 located between and connected to the first receiving chamber 51 and the second receiving chamber 52. The first end of the first connector 5 has an outer wall formed with an outer thread 511 and has an end portion formed with two radially opposite cutouts 54 each connected to the first receiving chamber 51 so that the mounting ring 4 is exposed from the cutouts 54 of the first connector 5. The second end of the first connector 5 has an outer wall formed with a holding portion 56 having a substantially hexagonal shape to facilitate a user holding and rotating the first connector 5.

The mounting ring 4 is mounted in the first receiving chamber 51 of the first connector 5 in a closely fit manner. The receiving space 41 of the mounting ring 4 has a first end formed with an opening 42 directed toward the conductive plug 3 and a second end connected to the passage 43. The passage 43 of the mounting ring 4 is connected to the receiving space 41 and connected to the neck portion 53 of the first connector 5. The passage 43 of the mounting ring 4 has a tapered shape and has a relatively narrower first end located adjacent to the receiving space 41 and a relatively wider second end located adjacent to the neck portion 53 of the first connector 5. The mounting ring 4 has a surface formed with an electrically plated layer so that the mounting ring 4 has an excellent electrically conductive feature.

The first electric cord 61 has an insulating outer cover 611 stopped by the neck portion 53 of the first connector 5. The first exposed electric wires 612 of the first electric cord 61 is extended through and guided by the neck portion 53 of the first connector 5 and the passage 43 of the mounting ring 4 into the receiving space 41 of the mounting ring 4.

The second connector 1 is detachably connected with the first connector 5. The through hole 12 of the second connector is connected to the mounting chamber 11. The first end of the second connector 1 has an inner wall formed with an inner thread 111 screwed onto the outer thread 511 of the first connector 5. The second end of the second connector 1 has an outer wall formed with a holding portion 16 having a substantially hexagonal shape to facilitate a user holding and rotating the second connector 1.

The conductive plug 3 is directed toward the receiving space 41 of the mounting ring 4. The conductive plug 3 has a cylindrical shape and has an open first end formed with a clamping hole 31 clamped on the second exposed electric wires 622 of the second electric cord 62 by a stamping working process and a closed second end formed with a conic portion 32 directed toward the opening 42 of the mounting ring 4. The conductive plug 3 has an outer wall formed with an electrically plated layer 33 so that the conductive plug 3 has an excellent electrically conductive feature. The conductive plug 3 is inserted into the receiving space 41 of the mounting ring 4 by rotation of the second connector 1 relative to the first connector 5.

The elastic member 2 is mounted on the second electric cord 62 and has a first end rested on a wall of the mounting chamber 11 of the second connector 1 and a second end rested on the conductive plug 3 to push the conductive plug 3 to partially protrude outward from the mounting chamber 11 of the second connector 1, so that the conic portion 32 of the conductive plug 3 protrudes outward from the mounting chamber 11 of the second connector 1 as shown in FIG. 2.

As shown in FIG. 3, when the second connector 1 is rotated relative to the first connector 5, the conductive plug 3 is inserted into the receiving space 41 of the mounting ring 4 so that the first exposed electric wires 612 of the first electric cord 61 is clamped between the conductive plug 3 and the mounting ring 4 so as to connect the second electric cord 62 to the first electric cord 61 exactly.

As shown in FIG. 2, the mounting ring 4 is exposed from the cutouts 54 of the first connector 5, so that a tool is inserted into the cutouts 54 of the first connector 5 to remove the mounting ring 4 from the first connector 5, thereby facilitating a user replacing the mounting ring 4.

As shown in FIGS. 4–7, the opening 42 of the receiving space 41 of the mounting ring 4 has a different diameter of $d_1$, $d_2$, $d_3$ and $d_4$, and the relatively narrower first end of the passage 43 of the mounting ring 4 has a different diameter of $S_1$, $S_2$, $S_3$ and $S_4$. In addition, the relatively wider second end of the passage 43 of the mounting ring 4 has a fixed diameter. Thus, the mounting rings 4 have different sizes to correspond to electric cords of different sizes.

Accordingly, the second exposed electric wires 622 of the second electric cord 62 is clamped by the conductive plug 3, and the first exposed electric wires 612 of the first electric cord 61 is clamped between the conductive plug 3 and the mounting ring 4, so that the second electric cord 62 is connected to the first electric cord 61 exactly. In addition, each of the conductive plug 3 and the mounting ring 4 is formed with an electrically plated layer so that the second electric cord 62 is connected to the first electric cord 61 smoothly by the conductive plug 3 and the mounting ring 4. Further, the second electric cord 62 and the first electric cord 61 are clamped and electrically conducted by the conductive plug 3 and the mounting ring 4, so that the second electric cord 62 is connected to the first electric cord 61 constantly by the conductive plug 3 and the mounting ring 4 even when the quick connecting device is immersed into an oily liquid at a high temperature. Further, the conic portion 32 of the conductive plug 3 protrudes outward from the mounting chamber 11 of the second connector 1 by the elastic force of the elastic member 2 so that the conductive plug 3 is aligned with and inserted into the receiving space 41 of the mounting ring 4 easily and rapidly, thereby facilitating a user connecting the second connector 1 to the first connector 5. Further, the inner thread 111 of the second connector 1 is fitted on the outer thread 511 of the first connector 5 closely by the elastic force of the elastic member 2 so that the second connector 1 is combined with the first connector 5 closely to prevent the second connector 1 from detaching from the first connector 5 during a long-term utilization. Further, the first connector 5 has a holding portion 56, and the second connector 1 has a holding portion 16 to facilitate the user holding and rotating the first connector 5.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A quick connecting device, comprising:

a first connector having a first end formed with a first receiving chamber and a second end formed with a second receiving chamber;

a metallic mounting ring mounted in the first receiving chamber of the first connector and having a first end formed with a receiving space and a second end formed with a passage;

a first electric cord having a distal end extended through the second receiving chamber of the first connector and provided with first exposed electric wires extended into the receiving space of the mounting ring;

a second connector having a first end formed with a mounting chamber mounted on the first connector and a second end formed with a through hole;

a second electric cord having a distal end extended through the through hole of the second connector into the mounting chamber and provided with second exposed electric wires;

a metallic conductive plug secured on the second exposed electric wires of the second electric cord and inserted into the receiving space of the mounting ring to contact the first exposed electric wires of the first electric cord so as to connect the second electric cord to the first electric cord;

an elastic member biased between the second connector and the conductive plug; and wherein the first end of the first connector has an end portion formed with two radially opposite cutouts each connected to the first receiving chamber so that the mounting ring is exposed from the cutouts of the first connector.

2. The quick connecting device in accordance with claim 1, wherein the first connector has a mediate portion formed with a reduced neck portion located between and connected to the first receiving chamber and the second receiving chamber.

3. The quick connecting device in accordance with claim 2, wherein the passage of the mounting ring is connected to the receiving space and connected to the neck portion of the first connector.

4. The quick connecting device in accordance with claim 2, wherein the first exposed electric wires of the first electric cord is extended through and guided by the neck portion of the first connector and the passage of the mounting ring into the receiving space of the mounting ring.

5. The quick connecting device in accordance with claim 1, wherein the first end of the first connector has an outer wall formed with an outer thread, the first end of the second connector has an inner wall formed with an inner thread screwed onto the outer thread of the first connector.

6. The quick connecting device in accordance with claim 5, wherein the inner thread of the second connector is fitted on the outer thread of the first connector closely by the elastic force of the elastic member so that the second connector is combined with the first connector closely to prevent the second connector from detaching from the first connector.

7. The quick connecting device in accordance with claim 1, wherein the second end of the first connector has an outer wall formed with a holding portion having a substantially hexagonal shape to facilitate a user holding and rotating the first connector.

8. The quick connecting device in accordance with claim 1, wherein the mounting ring is mounted in the first receiving chamber of the first connector in a closely fit manner.

9. The quick connecting device in accordance with claim 1, wherein the receiving space of the mounting ring has a first end formed with an opening directed toward the conductive plug and a second end connected to the passage.

10. The quick connecting device in accordance with claim 1, wherein the passage of the mounting ring has a tapered shape.

11. The quick connecting device in accordance with claim 1, wherein the passage of the mounting ring has a relatively narrower first end located adjacent to the receiving space and a relatively wider second end located adjacent to the neck portion of the first connector.

12. The quick connecting device in accordance with claim 1, wherein the mounting ring have different sizes to correspond to electric cords of different sizes.

13. The quick connecting device in accordance with claim 1, wherein the mounting ring has a surface formed with an electrically plated layer so that the mounting ring has an excellent electrically conductive feature.

14. The quick connecting device in accordance with claim 1, wherein the second end of the second connector has an outer wall formed with a holding portion having a substantially hexagonal shape to facilitate a user holding and rotating the second connector.

15. The quick connecting device in accordance with claim 9, wherein the conductive plug has a cylindrical shape and has an open first end formed with a clamping hole clamped on the second exposed electric wires of the second electric cord by a stamping working process and a closed second end formed with a conic portion directed toward the opening of the mounting ring.

16. The quick connecting device in accordance with claim 1, wherein the conductive plug has an outer wall formed with an electrically plated layer so that the conductive plug has an excellent electrically conductive feature.

17. The quick connecting device in accordance with claim 15, wherein the elastic member is mounted on the second electric cord and has a first end rested on a wall of the mounting chamber of the second connector and a second end rested on the conductive plug to push the conductive plug to partially protrude outward from the mounting chamber of the second connector, so that the conic portion of the conductive plug protrudes outward from the mounting chamber of the second connector.

18. The quick connecting device in accordance with claim 1, wherein the conductive plug is inserted into the receiving space of the mounting ring by rotation of the second connector relative to the first connector.

19. The quick connecting device in accordance with claim 1, wherein the second electric cord and the first electric cord are clamped and electrically conducted by the conductive plug and the mounting ring, so that the second electric cord is connected to the first electric cord constantly.

* * * * *